United States Patent [19]

Silvey et al.

[11] 4,443,989

[45] Apr. 24, 1984

[54] DANCE FLOOR CONSTRUCTION

[75] Inventors: Perry Silvey, New York, N.Y.; Ronald Bates, Demarest, N.J.

[73] Assignee: Lycan-Howard, Ltd., New York, N.Y.

[21] Appl. No.: 328,079

[22] Filed: Dec. 7, 1981

[51] Int. Cl.[3] ..... E04F 15/22; E04B 1/56

[52] U.S. Cl. ..... 52/402; 52/393; 52/480; 52/580; 52/593

[58] Field of Search ..... 52/402, 393, 144, 480, 52/580, 593

[56] References Cited

U.S. PATENT DOCUMENTS

| | | | |
|---|---|---|---|
| 1,407,679 | 2/1922 | Ruthrauff | 52/480 |
| 2,263,895 | 11/1941 | Larsen | 52/402 |
| 2,823,427 | 2/1958 | Kuhlman | 52/402 |

FOREIGN PATENT DOCUMENTS

| | | | |
|---|---|---|---|
| 2103383 | 8/1972 | Fed. Rep. of Germany | 52/480 |
| 998158 | 9/1957 | France | 52/592 |
| 359883 | 6/1938 | Italy | 52/592 |
| 280400 | 11/1927 | United Kingdom | 52/393 |

*Primary Examiner*—Alfred C. Perham
*Attorney, Agent, or Firm*—Lackenbach, Siegel, Marzullo, Presta & Aronson

[57] ABSTRACT

A dance floor construction is provided by a spaced, webbed, network of planks which are uniquely layered so that an air cushion space is provided at every cross-sectional area of the construction. The construction is unitized with tongue and groove interfitting for portable ready assembly of the flooring. The flooring is particularly suited for dancing, as well as for other uses.

4 Claims, 4 Drawing Figures

DANCE FLOOR CONSTRUCTION

FIELD OF THE INVENTION

This invention relates to flooring. More specifically this invention relates to flooring useful for dancing.

BACKGROUND AND DISCUSSION OF THE PRIOR ART

In theatres and dance studios it is desired that the flooring be cushioned to protect the feet and limbs of the dancers. Furthermore, it is often desirable to provide removable or portable flooring to accommodate varying needs of a theatre set. Still further it is desired to provide flooring which may readily be assembled and repaired.

Heretofore it was known in the prior art to provide cushioned flooring as is disclosed in Kodaras, U.S. Pat. No. 3,270,475; Dahlborg, U.S. Pat. No. 3,604,173; Omholt, U.S. Pat. No. 3,473,281, Chervaux, U.S. Pat. No. 3,946,529 and Coke, et al, U.S. Pat. No. 3,566,569.

Such flooring while cushioned at most parts of the surface, often had portions which were not cushioned, and which presented conditions of possible injury and therefore not entirely satisfactory to dancers.

It was also known in the general flooring field to provide floor in unitized panels, as is disclosed in Mellor, U.S. Pat. No. 4,087,948; and Bourgade, U.S. Pat. No. 4,090,338.

Now there is provided by the present invention, flooring units which when assembled, provide flooring which offers protection to dancers throughout the entire surface of the flooring.

It is therefore a principal object of the present invention to provide novel flooring which provides improved protection for dancers.

It is a further object of the present invention to provide flooring units which are readily constructed, and in which several units may be readily assembled and disassembled.

It is still another object of the present invention to provide flooring as aforesaid in which cushioning is provided accross the surface of the flooring.

It is still a further object to provide flooring which is of practical design and construction, and yet safe and practical in use.

The aforesaid as well as other objects and advantages will become apparent from a reading of the following specification, the adjoined claims, and the drawings in which:

DESCRIPTION OF THE PREFERRED EMBODIMENTS

Figure 1:
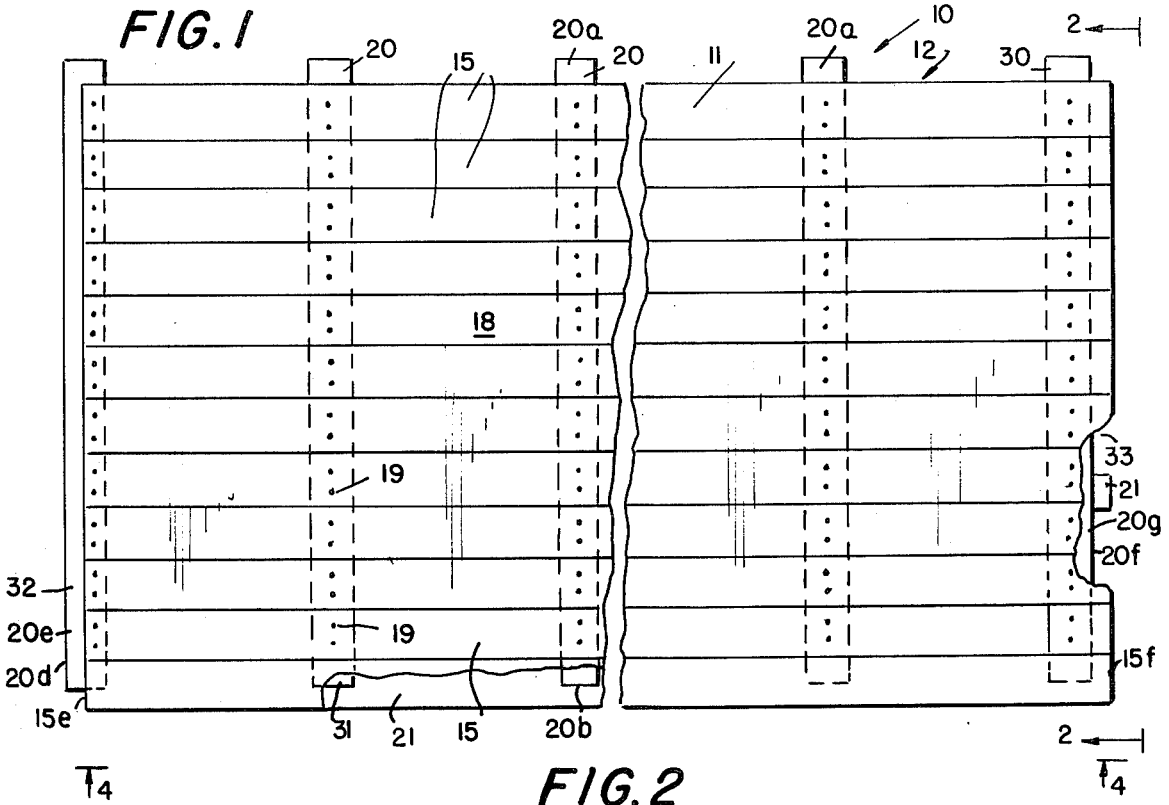
FIG. 1 is a top plan partial fragmentary view of the flooring.

Referring to the FIGURES there is shown the flooring unit of the present invention generally referred to as numeral 10. Unit 10 is formed of a covering 11, a first plurality or layer of wood planks 12, a second plurality or layer of wood planks 13, and a third plurality or layer of wood planks 14. Covering 11 is formed of a series of parallel wood planks 15, each formed and interfitted with tongue 16 and groove 17 construction so as to provide an even flat dance surface 18. The end boards 15*a* and 15*b* are provided with flat edges 15*c* and 15*d* for purposes hereinafter appearing. Planks 15 are assembled to the plurality of planks 12 by recessed nails 19, and the planks 12, 13 and 14 are assembled to each other by nails, glueing, or other well-known wood bonding means (not shown).

The individual planks 20 of plurality 12 are spaced in parallel arrangement, and are perpendicularly disposed to planks 15; and planks 21 of plurality 13 are in spaced parallel arrangement and are perpendicularly disposed to planks 20; and planks 22 of plurality 14 are in spaced parallel arrangement and are perpendicularly disposed to planks 21.

Figure 2:
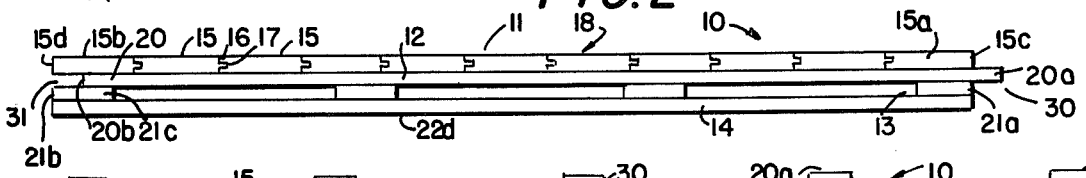
FIG. 2 is a side elevational view taken along line 2—2 of FIG. 1.
Figure 2:
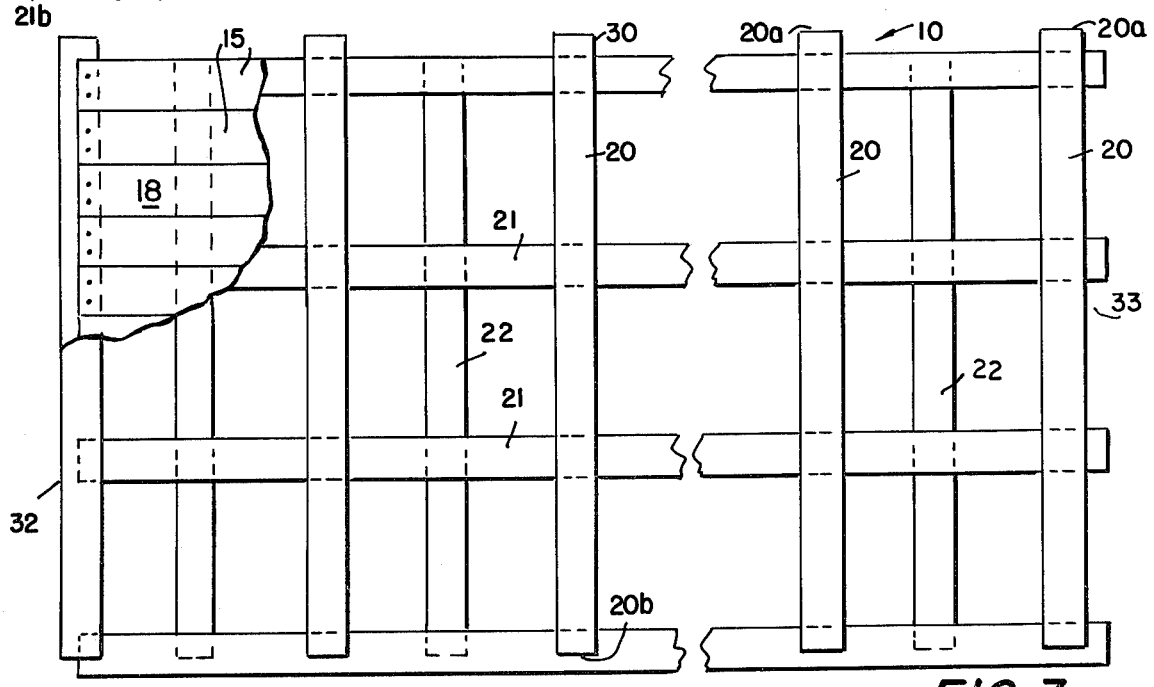
Figure 3:
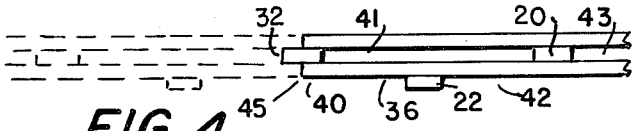
FIG. 3 is a top plan view as in FIG. 1 but with the flooring covering substantially removed in fragmentary view.

As best seen in FIG. 2, it is to be noted that end portions 20*a* of planks 20 extends outwardly from side edge 15*c* of plank 15 and side edge 21*a* of plank 21, so as to form a tongue 30. End edge 20*b* of plank 20 is recessed from edge 15*d* of plank 15*b* and from edge 21*b* of end plank 21*c* so as to form groove 31 oppositely disposed from tongue 30. Edge 20*d* of end plank 20*e* extends outwardly from covering plank edges 15*e* and edges 21*d* of planks 21 to form tongue 32 (see FIGS. 1 and 2). Edge 20*f* of end plank 20*g* is recessed from edges 15*f* and 21*d* to form groove 33. Tongue 32 is oppositely disposed from groove 33.

In this manner of construction a plurality of units 10 may be assembled by tongues 20*a* of one unit interengaging grooves 31 of an adjacent unit, and tongue 32 of one unit interengaging groove 33 of an adjacent unit, to provide any desired floor size.

Figure 4:
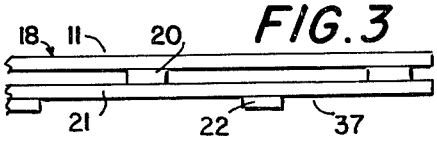
FIG. 4 is a front elevational view of the flooring of FIG. 3, with broken lines showing another unit in assembly.

It is important to note that while bottom planks 22 are in parallel disposition to planks 20 they are off-set from planks 20 and the outermost planks are inwardly disposed from the outermost planks 21 as at 36 and 37. In this manner of construction every sectional area under covering is provided with at least one cushion space such as 40, 41 42 and 43 (FIG. 4). Of course, the bottom surface 22*d* of planks 22 rests on a base floor (not shown).

It has been found that planks 15 and 21 are preferrably 8 feet long, and planks 20 and 22 are preferrably half that length, or 4 feet long. All planks are 3 inches wide by $\frac{3}{4}$ inch in thickness. Thus each unit encompasses surface area of 8 feet by 4 feet. It was surprisingly found that the planks could be constructed of yellow pine and found entirely suitable for its intended use.

It has been found that the yellow pine planks of the aforesaid dimensions required spacing at each of the layers of 14 to 20 inches measured from center line-to-center line of the planks, for optimum bounce and support characteristics. With changes in the wood character and dimension, one skilled in the art would know to accordingly change the spacing.

It is also to be noted that the present construction may be conveniently utilized for the on-ramps and off-ramps utilized by dancers.

The embodiments of the invention particularly disclosed and described herein above is presented merely as an example of the invention. Other embodiments, forms and modifications of the invention coming within the proper scope and spirit of the appended claims, will of course, readily suggest themselves to those skilled in the art.

It thus will be seen that there are provided a device and article of manufacture which achieve the various objects of the invention and which are well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

What is claimed is:

1. Flooring, comprising; an assembly unit comprising a covering; a first plurality of spaced parallel planks disposed beneath said covering; a second plurality of spaced parallel planks disposed beneath said first plurality of planks; and a third plurality of spaced parallel planks disposed beneath said second plurality of planks; and wherein said first and third pluralities of planks are parallel to each other, and said second plurality of planks is in perpendicular disposition to said other said pluralities of planks, and means to interconnect said covering and said planks, with said planks being so formed so as to provide cushion spaces beneath the surface of the covering, said means to interconnect said pluralities of planks and covering providing a unitized assembly, having four sides, with tongue and groove construction on each of the two oppositely disposed sides; wherein a portion of one plank of said first plurality of planks forms one of said tongues; wherein portions of said second plurality of planks and a portion of one plank of said first plurality and said covering, being formed so as to provide one of said grooves; wherein cushion spaces being provided below the entire covering surface; and whereby multiple units can be assembled to provide an entire cushioned floor of the assembled unit.

2. The flooring of claim 1, said third plurality being off-set from said first plurality.

3. The flooring of claim 1, wherein one side of the covering is about twice the length of the other side, and the length of said planks of said first and third pluralities is equal to the length of the longest side of said covering.

4. The flooring of claim 1, said wood being yellow pine and wherein the spacing of the planks of each plurality is 14 to 20 inches measured center line-to-center line.

* * * * *